US009127674B2

(12) United States Patent
Schultz

(10) Patent No.: US 9,127,674 B2
(45) Date of Patent: Sep. 8, 2015

(54) HIGH EFFICIENCY FIXED DISPLACEMENT VANE PUMP INCLUDING A COMPRESSION SPRING

(75) Inventor: John C. Schultz, Saline, MI (US)

(73) Assignee: GM Global Technology Operations, LLC, Detroit, MI (US)

( * ) Notice: Subject to any disclaimer, the term of this patent is extended or adjusted under 35 U.S.C. 154(b) by 935 days.

(21) Appl. No.: 12/820,753

(22) Filed: Jun. 22, 2010

(65) Prior Publication Data

US 2011/0311387 A1 Dec. 22, 2011

(51) Int. Cl.

| | |
|---|---|
| ***F04C 2/344*** | (2006.01) |
| ***F01C 19/08*** | (2006.01) |
| ***F01C 21/10*** | (2006.01) |
| ***F04C 15/00*** | (2006.01) |
| ***F01C 21/08*** | (2006.01) |

(52) U.S. Cl.

CPC ..... *F04C 2/3441* (2013.01); *F01C 19/085* (2013.01); *F01C 21/0836* (2013.01); *F01C 21/10* (2013.01); *F01C 21/108* (2013.01); *F04C 15/0061* (2013.01); *F04C 2240/80* (2013.01)

(58) Field of Classification Search

CPC .... F01C 19/085; F01C 21/0836; F01C 21/10; F01C 21/108; F04C 15/0061; F04C 2240/80; F04C 2/3441

USPC ..... 418/104, 126, 133, 259, 265–268, 78, 418/81, 135, 130, 69

See application file for complete search history.

(56) References Cited

U.S. PATENT DOCUMENTS

| | | | | | |
|---|---|---|---|---|---|
| 2,558,837 | A | * | 7/1951 | Frei | 418/69 |
| 3,104,746 | A | * | 9/1963 | Gadd et al. | 192/113.34 |
| 3,386,648 | A | * | 6/1968 | Van Rossem | 418/108 |
| 3,650,643 | A | * | 3/1972 | Grennan et al. | 418/126 |
| 3,822,965 | A | * | 7/1974 | Drutchas et al. | 417/53 |
| 3,844,696 | A | * | 10/1974 | Stiles et al. | 418/181 |
| 3,994,641 | A | * | 11/1976 | Southard | 418/93 |
| 4,014,630 | A | * | 3/1977 | Drutchas | 417/283 |
| 4,386,891 | A | * | 6/1983 | Riefel et al. | 418/81 |
| 4,408,963 | A | * | 10/1983 | Drutchas | 417/283 |
| 5,076,770 | A | * | 12/1991 | Dabling et al. | 418/1 |
| 5,192,196 | A | * | 3/1993 | Gettel | 417/300 |
| 5,807,090 | A | * | 9/1998 | Agner | 418/135 |
| 5,954,489 | A | * | 9/1999 | Kinoshita | 418/179 |

(Continued)

*Primary Examiner* — Mary A Davis
*Assistant Examiner* — Paul Thiede

(57) ABSTRACT

A vane pump for an automatic transmission includes a housing which may be spaced from the axis of the transmission input shaft axis and driven by a chain or gear train driven by the torque converter hub or disposed on and about the axis of the transmission input shaft and driven at engine speed. The vane pump includes a pair of port plates which reside on the end faces of a pump body having a cylindrical chamber which receives an eccentrically disposed rotor that is coupled to a stub shaft in an off-axis arrangement. The rotor includes a plurality of radial slots which receive a like plurality of vanes. The outer ends or edges of the vanes are in contact with the wall of the cylindrical chamber and the inner ends or edges are in contact with a pair of vane rings received within recesses in the ends of the rotor. The vanes are thus constrained between the wall of the chamber and the vane rings which positively determine their radial positions as they and the rotor rotate. Suitable inlet (suction) and outlet (pressure) ports in the port plates supply and collect hydraulic fluid to and from the cylindrical chamber. A compression spring biases the port plates and body together. The vane pump according to the present invention is self-priming and achieves high pumping efficiency.

19 Claims, 3 Drawing Sheets

(56) References Cited

U.S. PATENT DOCUMENTS

| | | | | |
|---|---|---|---|---|
| 6,499,964 | B2 * | 12/2002 | Staton et al. | 417/310 |
| 6,655,936 | B2 * | 12/2003 | Szeszulski et al. | 418/82 |
| 6,719,543 | B2 * | 4/2004 | Gentile et al. | 418/30 |
| 6,773,244 | B2 * | 8/2004 | Lee et al. | 418/216 |
| 7,083,394 | B2 * | 8/2006 | Dalton | 417/220 |
| 7,686,601 | B2 * | 3/2010 | O'Brien, II | 418/206.6 |
| 8,651,843 | B2 * | 2/2014 | Schultz | 418/110 |
| 2002/0068001 | A1 * | 6/2002 | Wong et al. | 418/133 |
| 2003/0113216 | A1 * | 6/2003 | Draskovits et al. | 417/307 |
| 2009/0241535 | A1 * | 10/2009 | Schultz et al. | 60/486 |
| 2009/0285709 | A1 * | 11/2009 | Mooy et al. | 418/139 |
| 2010/0016116 | A1 * | 1/2010 | Kenez et al. | 475/339 |
| 2011/0223050 | A1 * | 9/2011 | Park | 418/104 |

* cited by examiner

HIGH EFFICIENCY FIXED DISPLACEMENT VANE PUMP INCLUDING A COMPRESSION SPRING

FIELD

The present disclosure relates to a hydraulic pump for an automatic transmission and more particularly to a high efficiency fixed displacement vane pump for an automatic transmission.

BACKGROUND

The statements in this section merely provide background information related to the present disclosure and may or may not constitute prior art.

Hydraulic motor vehicle transmissions, that is, automatic transmissions for passenger cars and light duty trucks having a plurality of planetary gear assemblies controlled by clutches and brakes, generally include a dedicated hydraulic pump which provides pressurized transmission (hydraulic) fluid to control valves and actuators which engage the clutches and brakes and provide the various gear ratios or speeds.

Such dedicated pumps are generally fixed displacement pumps such as vane or gear pumps that are driven at engine speed from the hub of the torque converter or other startup device located between the engine and the transmission. Such pumps have many design goals. Since the pump is constantly driven at engine speed, it is desirable that it have high efficiency. Additionally, since the pump is most frequently mounted concentric to the engine axis, small size, particularly axial length, is desirable in order not to increase the length of the transmission. Such an on-axis engine driven pump must also be self-priming and must function reasonably well under cold start conditions when the transmission fluid has high viscosity because until hydraulic pressure is established, the transmission may be unable to shift into any gear.

SUMMARY

The present invention provides a fixed displacement vane pump for an automatic motor vehicle transmission. The vane pump includes a housing which may be disposed on-axis, that is, about the axis of the transmission input shaft or off-axis, that is, spaced from the transmission input shaft axis and driven by a chain or gear train driven by the engine. The pump itself includes a pair of port plates and a pump body. The pump body defines a cylindrical chamber which receives a rotor that is coupled by drive tangs, flats or splines to the torque converter hub if it is an on-axis design or a stub shaft if it is an off-axis design. The rotor is eccentrically disposed in the cylindrical chamber and thus defines a crescent shaped pumping chamber. The rotor includes a plurality of radial slots which receive a like plurality of vanes. The outer ends or edges of the vanes are in contact with the wall of the cylindrical chamber and the inner ends or edges are in contact with a pair of vane rings disposed within recesses in the rotor. The vanes are thus constrained between the wall of the pumping chamber and the rings which positively determine their radial positions as they and the rotor rotate. A Belleville spring or similar type of preload spring compresses the port plates against the pump body. Suitable inlet (suction) and outlet (pressure) ports supply and collect hydraulic fluid to and from the cylindrical chamber, respectively. Additionally, the outside (rear) surface of the rear port plate is exposed to the pressurized, pumped fluid and the resulting force further biases the port plates and pump body together, further reducing leakage.

The construction and configuration of this pump provides high pumping efficiency. Such efficiency is the result of several aspects of the fixed displacment vane pump of the present invention. First of all, in its preferred configuration and disposition, it is mounted off-axis in a transmission. In this way, the shaft which drives the vane rotor may be small, on the order of nine to twelve millimeters, rather than disposed on the much larger torque converter hub, sometimes as large as fifty millimeters which can significantly increase the diameter of the pump. The overall smaller pump diameter and component size of an off-axis pump reduces rotational and sliding friction, reduces rotating internal leakage and permits tighter tolerances, all factors which improve operating efficiency. In addition, an off-axis design facilitates other drive arrangements such as by a dedicated electric motor which has the additional capability of driving the pump when the engine is not running in, for example, engine start-stop (ESS) applications.

Furthermore, an off-axis design and the necessary accompanying drive arrangement such as sprockets and a chain or gears or a gear train allow a rotational speed increase or decrease relative to the rotational speed of the engine. This is useful because the typical limiting (minimum) pump flow occurs at low r.p.m., such as engine idle speed, and it may be desirable to increase this speed such that pump flow is greater at low engine speeds. This approach is not without a penalty, however, since the pump, so driven, will attain speeds and output flow at high engine speeds that may be unneeded and thus risk causing excessive noise and larger oil flow paths.

Given the current and on-going emphasis on transmission, powertrain and vehicle efficiency, several additional engineering approaches are available to address the above and related issues. For example, the displacement and fluid output of the pump may be reduced by providing an auxiliary pump that operates in conjunction with the pump, referred to here as the main pump to supply the transmission fluid demands of the transmission under various operating conditions. Preferably, the auxiliary pump is also a fixed displacement pump. The auxiliary pump may be driven by mechanical means such as a chain and sprockets at engine speed or other rotating speeds. Alternatively, in a hybrid powertrain, the auxiliary pump may be driven by an electric motor or other means which allows the auxiliary pump to be driven during electric-only operation when the engine and the engine driven pump are not operating. Additionally, the auxiliary pump may be a piezoelectric pump or other type of non-rotating pump.

The inclusion of vane rings renders the pump of the present invention self-priming. Maintaining close tolerances reduces internal pump leakage along rotor faces and adjacent to all surfaces and edges of the vanes which improves volumetric efficiency. Thus, the pump may be disposed above the sump and its fluid level, or at any desired off-axis location, either within the sump, below or above the nominal fluid level or at another location above or remote from the sump. This location/mounting flexibility facilitates use of a pump according to the present invention in both front wheel drive (FWD) and rear wheel drive (RWD) transmissions and drive trains.

An additional aspect of the reduced size, tight tolerances and the resultant self-priming ability is that the pump provides good cold start flow and pressure due to the positively controlled radial movement of the vanes. Moreover, these benefits are achieved by the pump configuration of the present invention utilizing conventional transmission fluid.

Thus it is an aspect of the present invention to provide a fixed displacement vane pump.

It is a further aspect of the present invention to provide a fixed displacement vane pump which may be mounted either on-axis or off-axis.

It is a still further aspect of the present invention to provide a fixed displacement vane pump having a crescent shaped pumping chamber.

It is a still further aspect of the present invention to provide a fixed displacement vane pump having a preload spring which compresses the port plates and pump body.

It is a still further aspect of the present invention to provide a fixed displacement vane pump having vane rings in contact with the inner edges of a plurality of vanes.

It is a still further aspect of the present invention to provide a fixed displacement vane pump having vanes which are constrained between the wall of the pumping chamber and vane rings within the rotor.

It is a still further aspect of the present invention to provide a fixed displacement vane pump suitable for use on both front wheel drive and rear wheel drive transmissions and drive trains.

It is a still further aspect of the present invention to provide a fixed displacement vane pump which is self-priming.

It is a still further aspect of the present invention to provide a fixed displacement vane pump which utilizes conventional transmission fluid.

Further aspects, advantages and areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
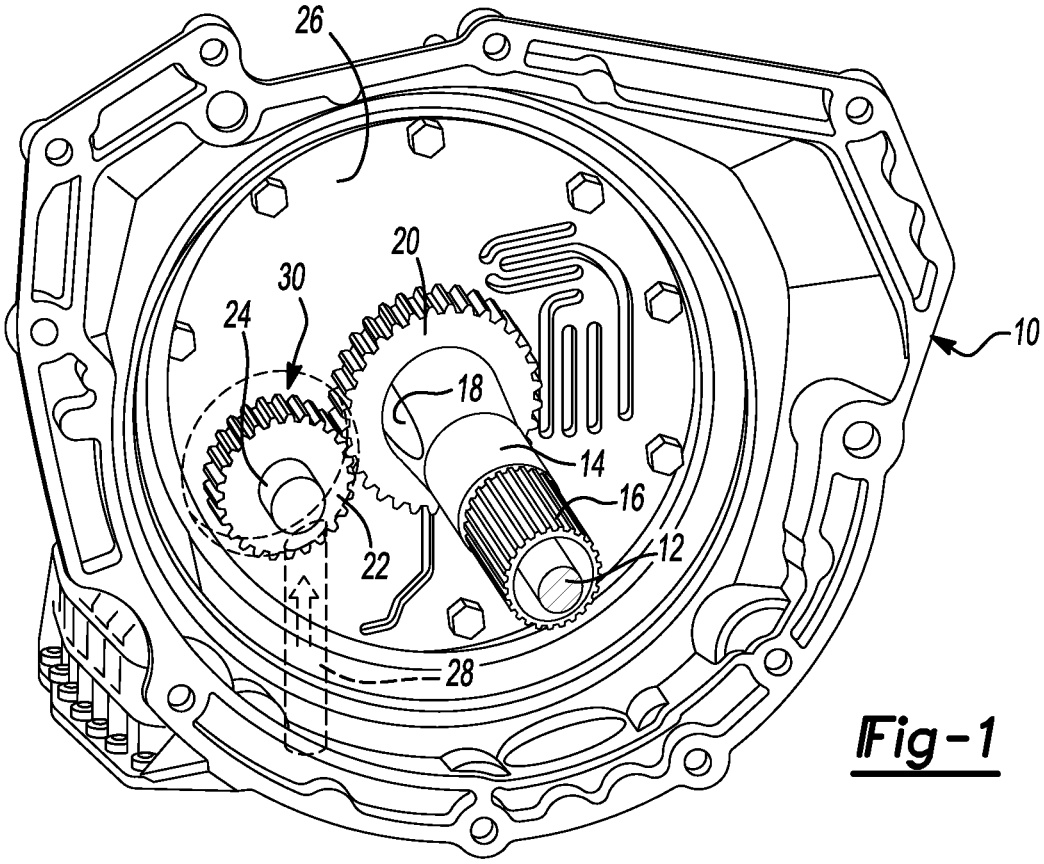
FIG. 1 is a front, perspective view of an automatic transmission housing incorporating a gear driven, off-axis, fixed displacement vane pump according to the present invention.

With reference to FIG. 1, a housing of a typical rear wheel drive (RWD) automatic transmission is illustrated and generally designated by the reference number 10. The transmission housing 10 is generally cast aluminum and includes openings, counterbores, flanges, shoulders and other features which receive, locate and support the various components of the automatic transmission. A drive or input shaft 12 is coupled to and driven by the output of a torque converter (not illustrated) and is coupled to and drives, for example, the input of a first gear set such as a planetary gear assembly (also not illustrated). Disposed concentrically about the transmission input shaft 12 is a quill or drive tube 14 having male splines 16 that engage and are driven by a torque converter hub (not illustrated) that rotates at engine speed. Attached to the quill or drive tube 14 by any suitable means such as, for example, complementary flats 18, interengaging splines, one or more drive pins or set screws, a friction fit or a combination of any of these elements is a first, drive gear 20. The first, drive gear 20 is in constant mesh with and drives a second, driven gear 22. The drive and driven gears 20 and 22 are preferably helical gears by may be spur gears or other types. The second, driven gear 22 is secured to and drives an input shaft 24 of a fixed displacement hydraulic pump 30 according to the present invention. The hydraulic pump 30 is mounted in a support plate 26 which typically includes a fluid inlet or suction passageway 28 for the hydraulic pump 30. As illustrated in FIG. 1, a consequence of the rotational reversal (from clockwise to counter-clockwise) achieved by the gears 20 and 22 is that the suction passageway 28 is disposed more proximate the center of the transmission housing 10, improving porting and further enhancing the mounting flexibility of the pump 30.

Figure 5:
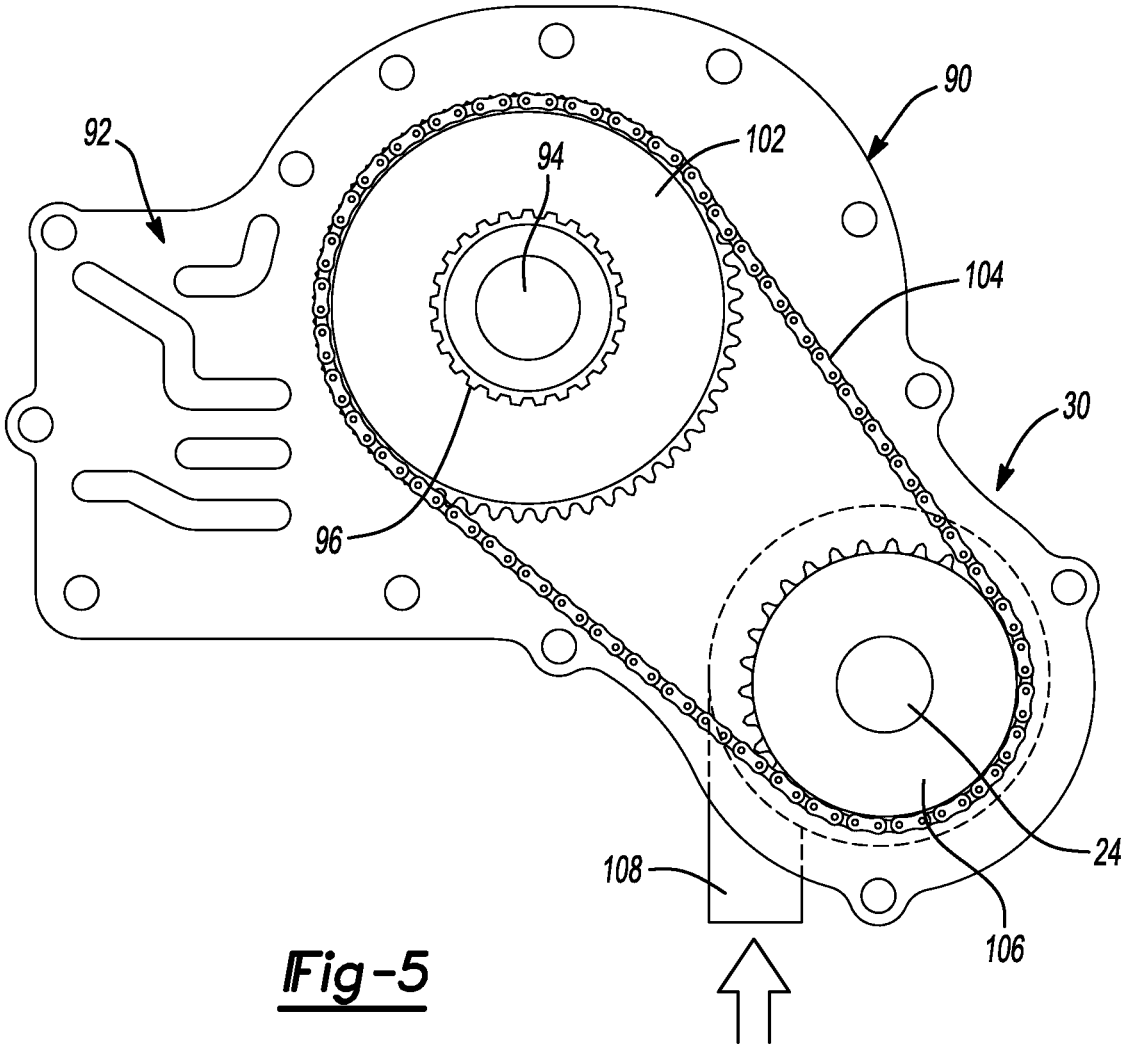
FIG. 5 is a front view of a pump body having a chain driven, off-axis, fixed displacement pump according to the present invention.

It should be appreciated that other parallel axis power transfer components such as a gear train or a pair of chain sprockets and a chain, such as illustrated in FIG. 5, may be utilized to drive the pump 30, or the pump 30 may be driven directly by the quill or drive tube 14. The latter arrangement necessitates significantly enlarging the diameter of the pump 30, however, and this compromises certain improvements in efficiency. It should also be appreciated that whereas in a direct drive arrangement, the speed of the pump 30 will and must always be the same as the speed of the engine and quill or drive tube 14, this drive arrangement readily facilitates a rotational speed difference between the speed of the quill 14 and the speed of the pump input shaft 24. For example, to improve slow speed operation and priming, the first, drive gear 20 may have a diameter larger than the diameter of the second, driven gear 22, thereby increasing the relative rotational speed of the hydraulic pump 30. As those familiar with gear and chain drive assemblies will readily understand, if it is desired that the hydraulic pump 30 rotate more slowly than the quill or drive tube 14, the larger and smaller diameter drive members need only be interchanged.

It should also be understood that the fixed displacement vane pump 30 of the present invention may be disposed proximate the quill or drive tube 14 at any convenient circumferential location. Finally, the vane pump 30 may be driven directly or indirectly by a dedicated electric motor (not illustrated), an arrangement which provides exceptional mounting location freedom as well as the ability to provide pressurized fluid when the vehicle engine is not operating.

Figure 2:
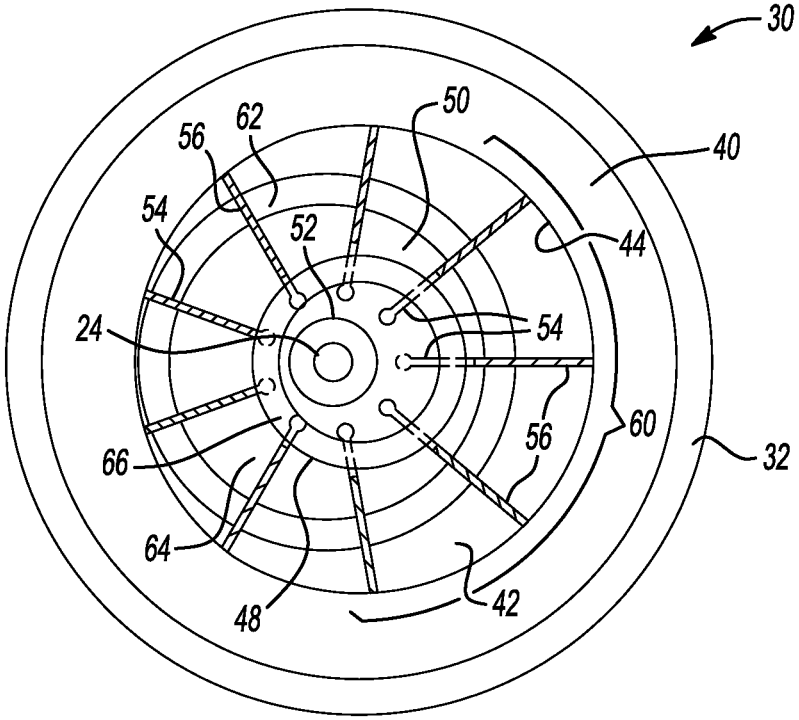
FIG. 2 is an end view of a fixed displacement vane pump according to the present invention.
Figure 3:
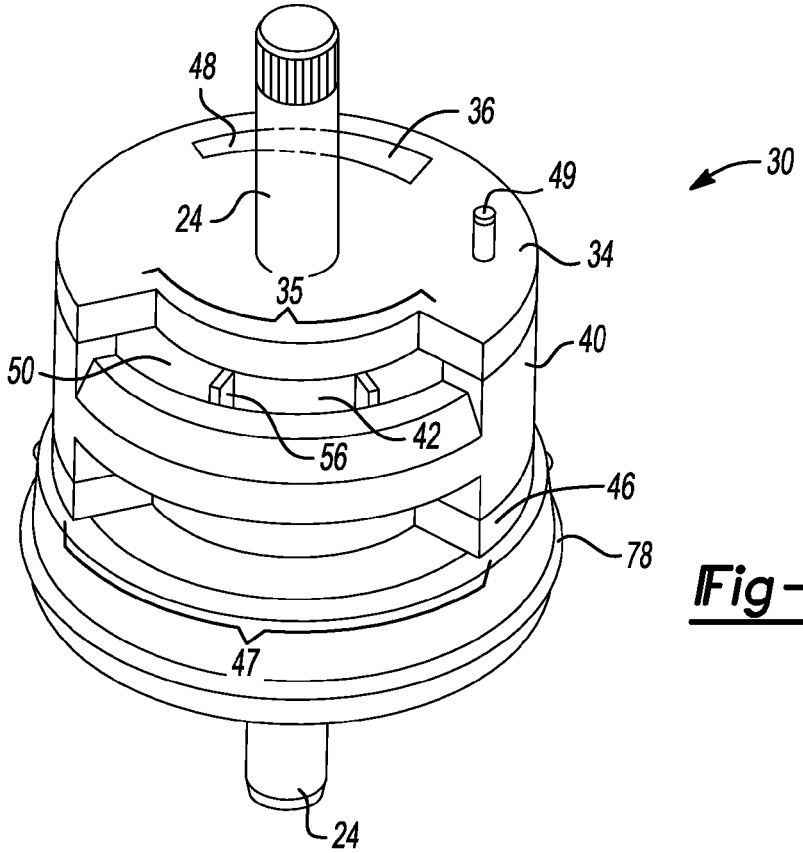
FIG. 3 is a perspective view of a fixed displacement vane pump according to the present invention with portions broken away.

Referring now to FIGS. 2 and 3, the hydraulic pump 30 may include its own, dedicated, generally cylindrical housing 32 which is secured to or integrally formed with the transmission housing 10 or be housed within the support plate 26 which is typically disposed at the front of the transmission housing 10. The housing 32 receives a stack or sandwich of three major components: a first circular port plate 34 defining a first circumferential inlet or suction port 35 and a first outlet or pressure port 36, a thicker annulus or pump body 40 defining a cylindrical chamber 42 having a wall or inner surface 44 and a second circular port plate 46 defining a second circumferential inlet or suction port 47 and a second outlet or pressure port 48. The three major components, the first circular port plate 34, the pump annulus or body 40 and the second circular port plate 46 are maintained in their proper relative rotational positions by one or more register pins or rods 49 that extend through at least portions of all three components.

Disposed eccentrically, i.e., offset from the axis of the cylindrical chamber 42, is a vane rotor 50. The vane rotor 50 is coupled to, is driven by and rotates with the input shaft 24 by and through a set of interengaging male and female splines 52, complementary flats or tangs. In turn, the input shaft 24 may be supported on a pair of bushings 53 or anti-friction bearings such as ball bearing assemblies.

The rotor 50 includes a plurality of radial slots or channels 54 which receive a like plurality of blades or vanes 56. Preferably, the rotor 50 includes nine of the slots or channels 54 and a like number of vanes 56 although this number can be adjusted up or down depending upon the size (diameter) of the rotor 50 and other design constraints and operating parameters. For reasons of pumping efficiency, it is desirable that the thickness of the vanes 56 be as thin as possible. Good results have been achieved with vanes on the order of 1.25 millimeters and thinner. It should be appreciated, however, that as the overall size (diameter) of the pump 30 increases to accommodate, for example, a torque converter hub or large shaft, the thickness of the vanes 56 will typically increase above the thickness just recited. Thin vanes 56 not only increase the volume of fluid pumped per revolution of the vane rotor 50 relative to a pump having thicker vanes but also reduce the energy required to radially translate the vanes 56 relative to vanes having greater mass.

The eccentric disposition of the vane rotor 50 within the pumping chamber 42 creates a curved or crescent shaped pumping chamber 60 which is the active portion of the cylindrical chamber 42. The curved or crescent shaped pumping chamber 60 has a vanishing radial distance or dimension where the vane rotor 50 is most proximate but clears the wall or inner surface 44 of the cylindrical chamber 42 and a maximum radial distance or dimension which is nominally equal to the difference between the diameter of the cylindrical chamber 42 and the diameter of the vane rotor 50. Proximate each end of the curved or crescent shaped pumping chamber 60 are the fluid ports. Assuming the rotation of the rotor 40 is clockwise as viewed in FIG. 2, the ports 35 and 47 proximate the increasing portion of the curved region 60 are inlet, suction or supply ports and the ports 36 and 48 proximate the decreasing portion of the pumping chamber 60 in the first circular port plate 34 and the second circular port plate 46, respectively, are outlet, pressure or supply ports. It will be appreciated that the ports 36 and 48 may define multiple openings and, alternatively, that they may be disposed in the wall or inner surface 44 of the cylindrical chamber 42.

Each end of the vane rotor 50 includes a shoulder or axially projecting lip 62 that defines a shallow, circular, re-entrant portion or recess 64. The axial length of the vane rotor 50 between the faces of the shoulders or lips 62 is preferably equal to the width (or axial dimension) of the vanes 56 (and just slightly less than the thickness of the pump annulus or body 40) and the axial distance between the circular, re-entrant portions or recesses 64 is significantly less. Received within each of the circular, re-entrant portions or recesses 64 of the vane rotor 50 is a vane ring or annulus 66. The vane rings or annuli 66 float or are freely disposed within the re-entrant portions or recesses 64. The outside diameters of the vane rings 66, which are preferably circular and of equal size, plus the radial length of two of the vanes 56 total very slightly less than the diameter of the cylindrical chamber 42. Thus, the vanes 56 are constrained both at their inner edges or ends by the pair of vane rings 66 and at their outer edges or ends by the wall or inner surface 44 of the cylindrical chamber 42.

This feature greatly improves performance of the fixed displacement pump 30 by improving volumetric efficiency because they provide an improved seal against the wall or inner surface 44 of the cylindrical chamber 42 so that less fluid flows against the direction of rotation of the vane rotor 50 and vanes 56. Moreover, this feature greatly improves self-priming, cold start and cold start, self-priming performance as the constrained vanes 56 again provide an improved seal against the wall or inner surface 44 at low rotational speeds when centrifugal force is minimal and when the high viscosity of the fluid inhibits outward radial translation of the vanes 56.

Figure 4:
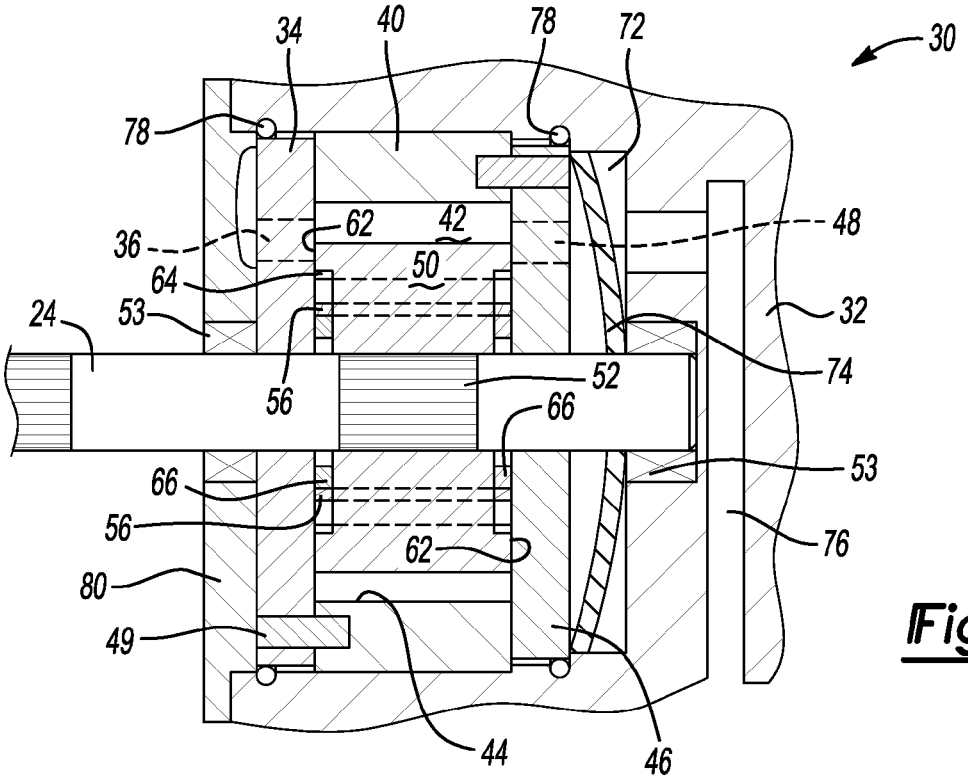
FIG. 4 is a side, elevational view in partial section of a fixed displacement vane pump according to the present invention.

Referring now to FIGS. 3 and 4, the housing 32 which receives the first circular port plate 34, the pump annulus or body 40 and the second circular port plate 46 includes a recessed region 72 which receives a wave washer or Belleville spring 74 which applies a compressive force or preload to these three components of the sandwich or stack, improves the fluid seal therebetween and thus further improves the efficiency of the pump 30 particularly at low, initial, or start-up speeds and pressures. The recessed region 72 collects, is filled with and communicates with a fluid outlet passageway 76.

Axial pressure compensation further reduces leakage in the pump 30 and further improves its efficiency. The outside (rear) surface of the second port plate 46 is exposed to the pressure of the pumped fluid and is therefore biased toward the pump annulus or body 40, in proportion to the pump output pressure, thereby further improving the seal between the three components of the sandwich. A plurality of O-ring seals 78 disposed between various elements of the pump 30 and the housing 32 also further reduce fluid leakage and improve efficiency. An end plate 80 which supports a bushing or bearing 53 and which may include suitable openings for threaded fasteners (not illustrated) seals and closes off the open end of the housing 32.

Referring now to FIG. 5, an alternate drive arrangement, typically for a front wheel drive (FWD) transmission, having a chain drive assembly is illustrated. In FIG. 5, the hydraulic pump 30 of the present invention is disposed in a prismatic housing 90 which may be disposed at any convenient location within the transmission housing 10, e.g., within the sump or at a level above the sump. The prismatic housing 90 typically includes hydraulic control valve passageways 92 as well as other passageways and receives a drive shaft 94 or other drive member such as a torque converter hub (not illustrated). Secured to the drive shaft 94 through any conventional means such as tangs, splines or flats 96 is a chain drive sprocket 102. The chain drive sprocket 102 engages and drives a chain 104 which, in turn engages and drives a driven chain sprocket 106. The driven chain sprocket 106 is secured by suitable means to the drive shaft 24 of the hydraulic pump 30 of the present invention. A fluid inlet passageway 108 communicates between a sump (not illustrated) and the inlet ports 35 and 47 (illustrated in FIG. 3). It will be appreciated that this chain driven, off-axis arrangement again permits relative speed adjustment between the drive shaft 94 and the pump drive shaft 24 by adjusting the relative diameters of the drive sprocket 102 and the driven sprocket 106.

The description of the invention is merely exemplary in nature and variations that do not depart from the gist of the invention are intended to be within the scope of the invention. Such variations are not to be regarded as a departure from the spirit and scope of the invention.

What is claimed is:

1. A fixed displacement vane pump comprising, in combination, a housing for receiving a body defining a cylindrical pumping chamber having a wall and first and second port plates defining axial ends of said pumping chamber, one of said port plates including a surface exposed to fluid pressurized by said fixed displacement vane pump, a rotor disposed eccentrically in said pumping chamber, said rotor having a shaft extending through said first and said second port plates and defining a plurality of circumferentially spaced-apart slots and axially extending circumferential lips defining opposed re-entrant end portions, a plurality of vanes disposed in said slots, said vanes having outer edges adapted to contact said wall of said pumping chamber, first and second bearings disposed between said shaft and said housing for rotatably supporting said shaft, a ring disposed in each of said re-entrant end portions, said vanes having inner edges adapted to contact said rings whereby said vanes are constrained to move radially between said wall of said pumping chamber and said rings as said rotor rotates, and a Belleville washer for axially biasing said body and said port plates together, said Belleville washer having a center opening for receiving said shaft.

2. The fixed displacement vane pump of claim 1 further including a driven gear secured to said shaft and a drive gear secured to an input member of a transmission whereby said shaft rotates oppositely relative to said input member.

3. The fixed displacement vane pump of claim 1 further including a driven chain sprocket secured to said shaft, a drive chain sprocket secured to an input member of a transmission and a chain engaging said sprockets.

4. The fixed displacement vane pump of claim 1 further including a first fluid port communicating with said pumping chamber for supplying fluid thereto and a second fluid port communicating with said pumping chamber for exhausting fluid therefrom.

5. The fixed displacement vane pump of claim 1 wherein said first and said second bearings are ball bearings.

6. A fixed displacement vane pump comprising, in combination, a housing for receiving a body defining a cylindrical pumping chamber having a wall and first and second circular members defining axial ends of said pumping chamber, said second circular member defining a surface exposed to pressure of fluid pumped by said fixed displacement vane pump, a rotor disposed eccentrically in said pumping chamber, said rotor including a shaft extending through said pair of circular members, said rotor defining a plurality of circumferentially spaced-apart slots and axially extending circumferential lips defining opposed re-entrant end portions, a plurality of vanes disposed in said slots, said vanes having outer edges adapted to contact said wall of said pumping chamber, first and second anti-friction bearings disposed between said shaft and said housing for rotatably supporting said shaft, a first fluid port in said first circular member communicating with said pumping chamber for supplying fluid thereto and a second fluid port in said second circular member for exhausting fluid therefrom;

a pair of rings disposed in respective said re-entrant end portions, said vanes having inner edges adapted to contact said rings whereby said vanes are constrained to move radially between said wall of said pumping chamber and said rings as said rotor rotates, and a compression spring for biasing said body and said pair of circular members together, said compression spring defining a center opening for receiving said shaft and locating said spring.

7. The fixed displacement vane pump of claim 6 further including a driven chain sprocket secured to said shaft, a drive chain sprocket secured to an input member of a transmission and a chain engaging said sprockets.

8. The fixed displacement vane pump of claim 6 further including a driven gear secured to said shaft and a drive gear secured to an input member of a transmission.

9. The fixed displacement vane pump of claim 6 wherein rotor includes nine slots and nine vanes.

10. The fixed displacement vane pump of claim 6 wherein an axial width of said vanes is substantially equal to an axial width of said rotor between said lips.

11. The fixed displacement vane pump of claim 6 wherein said compression spring is one of a Belleville spring and a wave washer.

12. The fixed displacement vane pump of claim 6 wherein said first and said second circular members are port plates.

13. A fixed displacement vane pump comprising, in combination, a housing adapted to receive a body defining a generally cylindrical chamber having a circumferential wall and first and second circular members defining respective axial ends of said cylindrical chamber, a rotor disposed on and coupled to a shaft, said rotor and said shaft disposed eccentrically in said cylindrical chamber, said rotor defining a plurality of circumferentially spaced-apart radial slots and a pair of axially extending circumferential lips defining opposed re-entrant end portions, a plurality of vanes disposed in said slots, said vanes having outer edges adapted to contact said wall of said cylindrical chamber, a first bearing and a second bearing disposed between said shaft and said housing for rotatably supporting said shaft, at least one fluid inlet port in one of said pair of circular members communicating with said cylindrical chamber for supplying fluid thereto and at least one fluid outlet port in another of said pair of circular members communicating with said cylindrical chamber for exhausting fluid therefrom, said another of said pair of circular members having a surface exposed to pressurized fluid from said fluid outlet port, a ring disposed in each of said re-entrant end portions, said vanes having inner edges adapted to contact said rings, and a compression washer adapted to bias said body and said pair of circular members together, said compression washer defining a center opening for receiving said shaft and positioning said compression washer about said shaft, whereby said vanes are positively constrained to move radially by said wall of said cylindrical chamber and said rings as said rotor rotates.

14. The fixed displacement vane pump of claim 13 wherein said compression washer is one of a Belleville spring and a wave washer.

15. The fixed displacement vane pump of claim 13 further including a first gear driven by an input member meshing with a second gear coupled to said shaft whereby said shaft rotates in a direction opposite to rotation of said input member.

16. The fixed displacement vane pump of claim 13 further including a driven chain sprocket secured to said shaft, a drive chain sprocket secured to an input shaft of a transmission and a chain engaging said sprockets.

17. The fixed displacement vane pump of claim 13 further including a seal disposed between said housing and one of said circular members.

18. The fixed displacement vane pump of claim 13 wherein said first and said second circular members are port plates.

19. The fixed displacement vane pump of claim 13 wherein said first bearing and said second bearing are anti-friction bearings.

* * * * *